US007287154B1

(12) United States Patent
Puckette

(10) Patent No.: US 7,287,154 B1
(45) Date of Patent: Oct. 23, 2007

(54) ELECTRONIC BOOT UP SYSTEM AND METHOD

(75) Inventor: Robert Puckette, Corvallis, OR (US)

(73) Assignee: Trimble Navigation Limited, Sunnyvale, CA (US)

( * ) Notice: Subject to any disclaimer, the term of this patent is extended or adjusted under 35 U.S.C. 154(b) by 428 days.

(21) Appl. No.: 10/770,647

(22) Filed: Feb. 2, 2004

(51) Int. Cl.
*G06E 7/60* (2006.01)

(52) U.S. Cl. ..... 713/1; 713/2; 703/28; 703/24; 703/23

(58) Field of Classification Search ..... None
See application file for complete search history.

(56) References Cited

U.S. PATENT DOCUMENTS 5,692,190 A * 11/1997 Williams ..... 713/2

6,799,157 B1 * 9/2004 Kudo et al. ..... 703/28

* cited by examiner

*Primary Examiner*—A. Elamin

(57) ABSTRACT

An electronic processing boot up system and method are presented. The electronic processing boot up system and method can utilize ROM emulation to store bootstrap instructions and to facilitate reduction of relatively expensive ROM. For example, a ROM emulation system and method utilizes minimal or no ROM. An electronic processing boot up system can include a bus, a processor, and a ROM emulation system for making bootstrap information available to the processor. The processor can issue an initial memory fetch request and the ROM emulation system can perform a ROM emulation process in response to the memory fetch request. The ROM emulation process can include receiving a fetch request for information, translating the fetch request into memory compatible commands for retrieving the information, holding off the processor while the information is retrieved, and forwarding the information in a format compatible with a reply to the memory fetch.

20 Claims, 5 Drawing Sheets

ELECTRONIC BOOT UP SYSTEM AND METHOD

BACKGROUND OF THE INVENTION

1. Field of the Invention

The present invention generally relates to read only memory (ROM) emulation. More particularly, the present invention relates to the field of retrieving start up instructions (e.g., bootstrap instructions) from a ROM emulation system.

2. Related Art

Electronic systems and circuits have made a significant contribution towards the advancement of modern society and are utilized in a number of applications to achieve advantageous results. Numerous electronic technologies such as digital computers, audio devices, video equipment, and telephone systems have facilitated increased productivity and reduced costs in analyzing and communicating data in most areas of business, science, education and entertainment. Frequently, these advantageous results are realized through the use of information stored on a memory media and manipulated by a processing device. The number and type of memory storage medium can have significant impacts on the performance and cost of ah information processing system.

Memories usually consist of a location for storing information and a unique indicator or address. There are a variety of different types of memory and the type of memory usually dictates the features or characteristics of a memory. For example, non-volatile memory typically retains information when power is disconnected and a volatile memory typically loses information when power is disconnected. There is usually an inverse tradeoff between cost and performance and reaching an optimized balance is often difficult. For example, faster memories are usually more expensive per bit of storage capacity and slower memories are usually cheaper per bit of storage capacity. However, the function information is associated with (e.g., bootstrap operation) and the interactions involved in conveying the information to other components often constrains the choice of memory type.

A number of electronic systems include processors that are started by a bootstrap process. The bootstrap process typically causes a computer system to start executing instructions in a bootstrap loader program (e.g., a short machine language program). For example, personal computers often include bootstrap instructions in a nonvolatile memory, such as a read only memory (ROM), that are automatically executed upon startup. A bootstrap process is usually started by an indication of a triggering event such as the power is turned on for a computer system, a reset switch is pressed and/or a software restart instructions are executed. The bootstrap instructions typically include instructions for directing a number of different functions including hardware tests (e.g., power on self test, etc.), initializations, and routine input/output ("I/O") functions (e.g., BIOS instructions). The bootstrap operations also typically include searching for the location of operating system instructions, loading the operating system instructions and passing control to the operating system.

Since bootstrap operations are usually performed when a system is started up the bootstrap information is typically stored in a non-volatile memory so that it is available even though the power was shut off prior to start up. In addition, the bootstrap information is typically stored in a memory that is compatible with a processor's requirement for relatively fast simple memory access for instruction fetches. For example, very old boot up approaches typically store boots strap instructions in a separate ROM memory. However, ROM memory can not typically be reprogrammed and it is very difficult to fix potential problems (e.g., software bugs). In addition, ROM memories are usually mask-programmed at the factory with adds considerable time to product deployment.

Systems tended to utilize NOR flash re-programmable ROM memory or electrically programmable read only memory (EPROM). However, NOR flash re-programmable ROM memory and EPROM memory is typically relatively expensive per bit of storage capacity. As systems become more complex, bootstrap activities can become very involved and take a significant amount of storage space. The additional storage space requirements can result in increased costs associated with relatively expensive ROM.

In addition, providing separate memories chips dedicated to separate functions such as storing bootstrap information usually involves consumption of system resources and added costs. Memories dedicated to single function instructions stored on separate chips typically occupy precious board space and need added connections on the board. Coordinating the connection and interaction with separate dedicated memory chips also usually complicates design efforts.

SUMMARY OF THE INVENTION

An electronic processing boot up system and method are presented. The electronic processing boot up system and method utilizes ROM emulation to store bootstrap instructions. In one embodiment, a ROM emulation system and method facilitates reduction of relatively expensive ROM. For example, a ROM emulation system and method utilizes minimal or no ROM and can enable an electronic system to start up without a separate dedicated ROM memory chip.

In one exemplary implementation, an electronic processing boot up system includes a bus for communicating information, a processor for processing the information, and a ROM emulation system for making bootstrap information available to the processor. The processor can issue an initial memory fetch request and the ROM emulation system can perform a ROM emulation process in response to the memory fetch request. When bootstrap operations are complete, control can be passed to an operating system. In one embodiment, the ROM emulation process includes receiving a fetch request for information, translating the fetch request into memory compatible commands for retrieving the information, holding off the processor while the information is retrieved, and forwarding the information in a format compatible with a reply to the memory fetch.

BRIEF DESCRIPTION OF THE DRAWINGS

The accompanying drawings, which are incorporated in and form a part of this specification, illustrate embodiments of the invention and, together with the description, serve to explain the principles of the present invention. The drawings referred to in this description should not be understood as being drawn to scale except if specifically noted.

DETAILED DESCRIPTION

Figure 1:
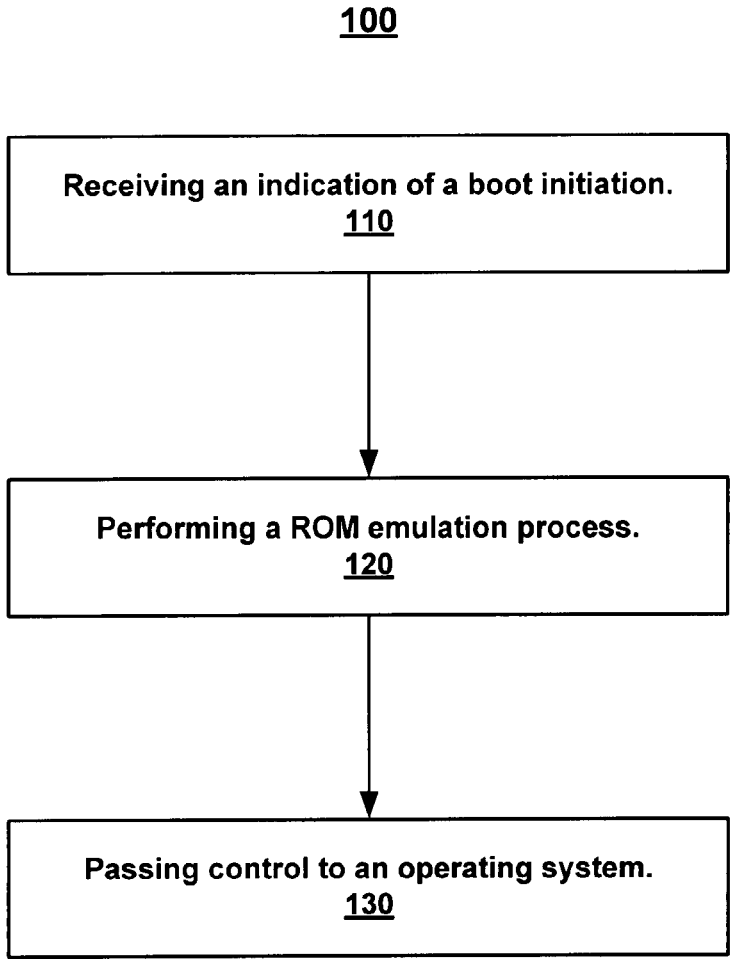
FIG. 1 is a flow chart of an electronic processing boot up method in accordance with one embodiment of the present invention.

Reference will now be made in detail to the embodiments of the invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following detailed description of the present invention, numerous specific details are set forth in order to provide a thorough understanding of the present invention. However, it will be obvious to one of ordinary skill in the art that the present invention may be practiced without these specific details. In other instances, well known methods, procedures, components, and circuits have not been described in detail as not to unnecessarily obscure aspects of the present invention.

Some portions of the detailed descriptions which follow are presented in terms of procedures, steps, logic blocks, processing, and other symbolic representations of operations on data bits within a computer memory. These descriptions and representations are the means used by those skilled in the data processing arts to convey most effectively the substance of their work to others skilled in the art. A procedure, computer executed step, logic block, process, etc., are here, and generally, conceived to be self-consistent sequences of steps or instructions leading to a desired result. The steps are those requiring physical manipulations of physical quantities. Usually, though not necessarily, these quantities take the form of electrical or magnetic signals capable of being stored, transferred, combined, compared, and otherwise manipulated in a computer system. It has proven convenient at times, principally for reasons of common usage, to refer to these signals as bits, values, elements, symbols, characters, terms, numbers, or the like.

It should be borne in mind, however, that all of these and similar terms are to be associated with the appropriate physical quantities and are merely convenient labels applied to these quantities. Unless specifically stated otherwise as apparent from the following discussions, it is appreciated that throughout the present invention, discussions utilizing terms such as "processing," "computing," "translating," "instantiating," "determining," "displaying," "recognizing," or the like, refer to the action and processes of a computer system, or similar electronic computing device, that manipulates and transforms data represented as physical (electronic) quantities within the computer system's registers and memories into other data similarly represented as physical quantities within the computer system registers or memories or other such information storage, transmission, or display devices.

A present invention electronic boot up system and method utilizes ROM emulation to store bootstrap instructions. In one embodiment, a ROM emulation system and method enables an electronic system to start up without separate ROM memory for storing bootstrap information. Present invention ROM emulation can interpret a ROM compatible fetch request, retrieve the information from a non-ROM memory (e.g., a NAND flash), and return the information in reply compatible with the fetch request. In addition, ROM emulation components can be utilized to perform other functions, including providing control for other functions (e.g., touch screen control, audio control, etc.) and storing additional information in the memory utilized for ROM emulation.

FIG. 1 is a flow chart of electronic processing boot up method 100 in accordance with one embodiment of the present invention. Electronic processing boot up method 100 permits electronic systems to be "booted up" using ROM emulation. The ROM emulation utilizes minimal or no ROM to emulate a separate ROM memory. It is appreciated that electronic processing boot up method 100 can be implemented in different systems and is compatible with a variety of non-ROM memories.

In step 110, an initial memory fetch is initiated. In one embodiment of the present invention, the initial memory fetch is initiated in response to an indication of a bootstrap launch. In one embodiment, an indication of a bootstrap triggering event (e.g., the power is turned on for a computer system, a reset switch is pressed, and/or a software restart instructions are executed, etc.) is received and an initial memory fetch is initiated. In one exemplary implementation, the initial memory fetch is for information at logical memory address zero of a system.

In step 120, a read only memory (ROM) emulation process is performed. The ROM emulation process can permit a component to issue information fetch requests compatible with ROM protocol and access information in a different type of memory. In one embodiment, a ROM emulation process interprets a ROM compatible fetch request, retrieves the information from a non-ROM memory (e.g., a NAND flash), and returns the information in a reply compatible with the fetch request. For example, a fetch request from a processor for bootstrap information at logical memory address location zero is interpreted, the bootstrap information is retrieved from a NAND flash memory location, and the bootstrap information is returned to the processor in a reply format compatible with the fetch request (e.g., a format the processor can handle).

Figure 2:
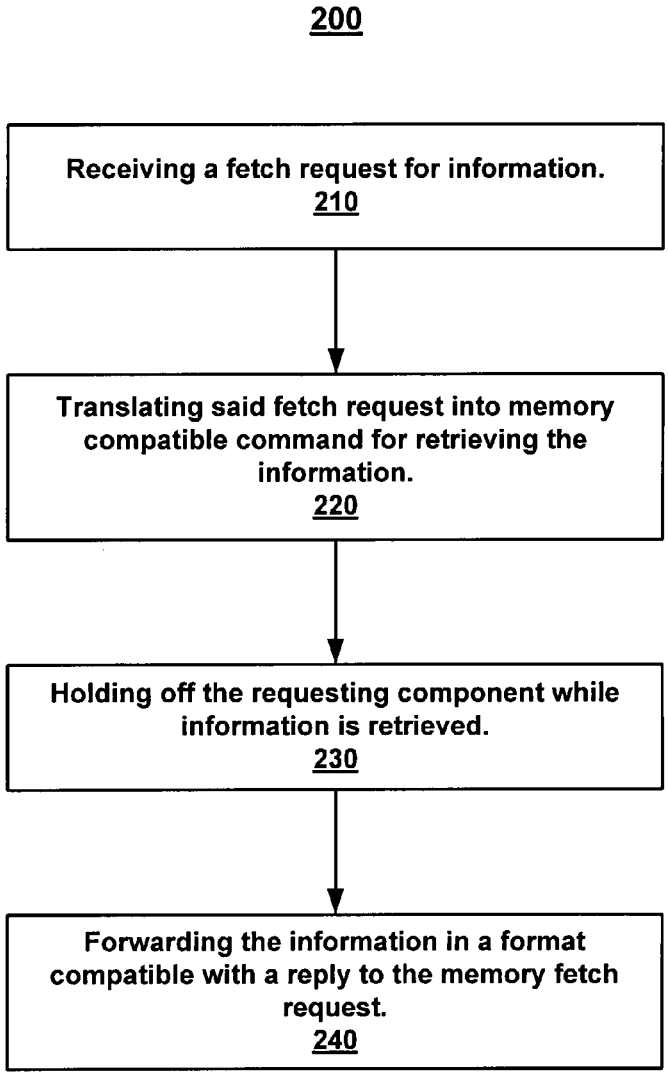
FIG. 2 is a flow chart of a read only memory (ROM) emulation process in accordance with one embodiment of the present invention.

FIG. 2 is a flow chart of read only memory (ROM) emulation process 200 in accordance with one embodiment of the present invention. ROM emulation process 200 is compatible with a variety of ROM fetch request protocols. It is appreciated that ROM emulation process 200 can be implemented with a variety of non-ROM memories (e.g., NAND flash, peripheral disk, etc.).

In step 210, a fetch request for information is received from a component (e.g., a processor). In one embodiment of the present invention, the fetch request is received by a ROM emulation system. For example, processor fetch requests related to initial bootstrap operations are received by a ROM emulation system. A processor can issue a fetch request for information from a logical memory address location zero and the fetch can be forwarded to a ROM emulation system.

At step 220, the fetch request is translated into memory compatible commands for retrieving the information. In one embodiment of the present invention, the memory commands are compatible with a NAND flash memory. For example, the translating includes translating a ROM memory access fetch request into NAND flash memory compatible commands. The NAND flash memory commands include commands directing retrieval of the information from a NAND flash memory.

With reference still to FIG. 2, the requesting component (e.g., processor) is held off while the information is retrieved in step 230. In one exemplary implementation, the processor is held off by a ready handshake protocol. For example, a ready signal is de-asserted in response to the fetch request and the ready signal is asserted when the information is in a format compatible with a reply to the memory fetch request. In another exemplary implementation, the processor is held off by issuing non-operation (NOP) instruction op-codes.

In step 240, the information is forwarded in a format compatible with a reply to the memory fetch. For example, information retrieved in accordance with a "serial" memory command protocol (e.g., an address is provided to a memory and data is returned on the same lines) and converted to a processor compatible parallel protocol (e.g., address and data are sent in parallel.). In one exemplary implementation, information is retrieved in step 220 sequentially (e.g., via multiplexing) and converted for parallel forwarding to a processor (e.g., via de-multiplexing).

In one embodiment of the present invention, the instructions from the non-ROM memory (e.g., NAND Flash memory) include random access memory (RAM) initialization instructions to initialize or "turn on" a RAM. Information from the non-ROM memory is copied to the RAM, including bootstrap information. In one exemplary implementation, the balance of bootstrap information is retrieved from RAM once the RAM has been initialized and the information copied from the NAND flash memory. In one exemplary implementation, initializing the RAM and copying the balance of the bootstrap information relatively early in the boot up process can permit the remainder of the boot process to proceed faster since information is retrieved directly from the RAM once it is initialized. The bad pages of the NAND flash memory can be marked and skipped when copying information from the non-ROM memory (e.g., the NAND flash).

Referring again to FIG. 1, control is passed to an operating system in step 130. In one embodiment of the present invention the operating system information is also downloaded from the non-ROM memory to the RAM. The present invention is compatible with a variety of operating systems. The system can be capable of performing a variety of operating system functions.

Figure 3:
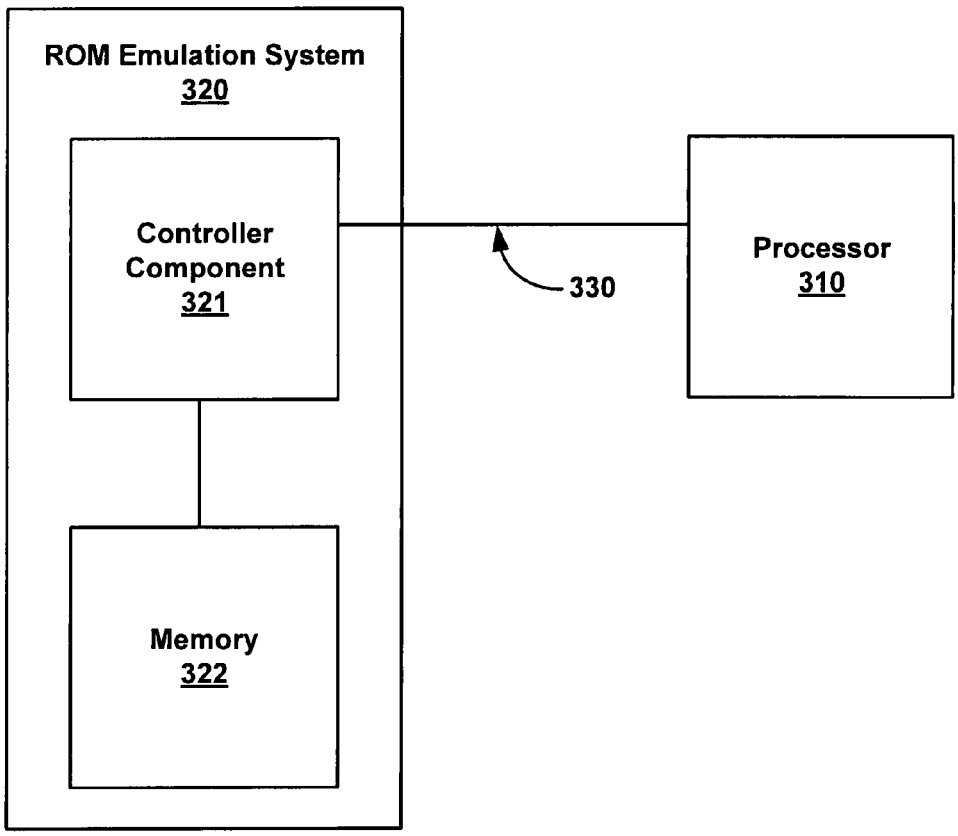
FIG. 3 is a block diagram of an electronic processing boot up system in accordance with one embodiment of the present invention.

FIG. 3 is a block diagram of electronic processing boot up system 300 in accordance with one embodiment of the present invention. Electronic processing boot up system 300 comprises a processor 310, ROM emulation system 320 and bus 330. Bus 330 is coupled to processor 310 and ROM emulation system 320. Bus 310 communicates information between processor 310 and ROM emulation system 320. Processor 310 processes the information. ROM emulation system 320 makes information (e.g., bootstrap information) available to processor 310.

In one embodiment of the present invention, ROM emulation system 320 comprises controller component 321 and memory 322. ROM emulation system 320 utilizes various types of non-ROM memory to emulate a ROM memory. In one exemplary implementation, memory 322 is a NAND Flash memory (e.g., storing boot up information) and ROM emulation system 320 utilizes the NAND Flash memory to emulate a ROM memory. Controller component 321 interprets fetch requests from processor 310, generates commands for retrieving boot up information from the NAND flash memory (e.g., 322) and forwards the boot up information to the processor 310 in a format compatible for replies to the processor. The commands generated by controller component 321 are compatible with the NAND flash memory protocol for retrieving information.

It is appreciated that controller component 321 is readily adaptable for a variety of system configurations. For example, controller component 321 can be configured to interpret fetch requests from a variety of different requesting components including processors. In addition, controller component 321 can be configured to interact with a variety of non-ROM memories (e.g., NAND flash, peripheral disk, etc.).

In one embodiment of the present invention, controller component 321 includes a field programmable gate array (FPGA), custom chip application specific integrated circuit (ASIC) and/or other digital logic system. The controller component 321 can implement a state machine for holding off the processor while interpreting a fetch request and assembling a memory retrieval instruction stream on the fly for retrieving information (e.g., boot up information) from memory 322 (e.g., NAND flash). For example, the state machine can direct ready handshake protocol responses to a fetch request.

In one embodiment, controller component 321 can include a small ROM memory integrated with the controller for storing a small amount of information for establishing handshaking protocols without storing other bootstrap information. Thus, the small ROM is much smaller than a traditional ROM that stores the bootstrap information. The integrated ROM does not consume addition board space or require additional board connections that a separate ROM chip otherwise would.

In one exemplary implementation, controller component 321 is accessible via a join test action group (JTAG) port (not shown) for directly controlling electrical signals in the electronic processing boot up system to effect programming of the NAND flash memory with the bootstrap loader and/or operating system. The JTAG port can be utilized to co-opt the functions of NAND flash lines and bring a system that is completely down (e.g., lost operating system, bootstrap loader instructions, etc.) back to functionality.

In an alternate embodiment of the present invention, electronic processing boot up system 300 can include a RAM (not shown). ROM emulation system 320 can provide boot up information to processor 310 until the RAM is initialized or "turned on". ROM emulation system 320 can also provide the balance of boot up information to the RAM and processor 310 can retrieve the balance of the boot up information from the RAM through interactions with the RAM (e.g., directly from the RAM). In one exemplary implementation of the present invention, operating system instructions are also copied to the RAM and control of the system is turned over to the operating system when the bootstrap operations are complete.

In one embodiment of the present invention, ROM emulation is performed in sequential phases, a micro loader phase, a state machine phase, a RAM copying phase, and a RAM implementation phase. A controller (e.g., a field programmable gate array) includes three memory areas or address ranges. A micro loader range (e.g., address 0 to 0-0x77) for initializing ROM emulation operations. The micro loader range can be implemented in a small ROM integrated with a ROM emulation controller component. A control register range (e.g., 0x78-0x7f) for permitting direct control of NAND flash memory. A state machine range (e.g., 0x80-0x7ff) for storing state machine based ROM emulation instructions. Access to this memory range can be converted to NAND flash commands appropriate for fetching data at the request of a processor component.

The micro loader phase initializes ROM emulation operations. The mirco loader phase is primarily responsible for establishing ready handshaking operations to hold off a processor during ROM emulation. For example, a micro loader phase can include activation of a ready signal as an alternate function of a general purpose input/output (GPIO), allocation of a GPIO as an output for the auxiliary clock (AUCLK) function, turning on inputs, turning on an audio function (e.g., for clock the FPGA controller), setting a static memory bank to a slow specified width (e.g., 16 bit wide) variable latency memory, selecting a clock rate (e.g., 12 MHz), and jumping to a RAM initialization phase (e.g., to instructions at the memory range for the state machine instructions).

The state machine phase involves state machine based ROM memory emulation. Fetch requests are automatically converted to a sequence of NAND flash commands. In one exemplary implementation, the state machine phase can include turning a RAM on, turning on instruction caching, setting CPU speed, copying the state machine emulation code to RAM, and jumping to the RAM copy of the state machine emulation code.

The RAM copying phase involves copying the remainder of the bootstrap information from the ROM emulation system to RAM. The state machine approach can be discontinued and page accesses in manual mode can be performed. In one embodiment, direct control of a ROM emulation system memory (e.g., NAND flash memory) is provided (e.g., by a ROM emulation system controller component), including control of a read strobe line, chip enable line, write strobe line, command strobe line, address strobe line, chip ready status line, and chip write protect line. Bad pages in the NAND flash memory can be marked and skipped when copying the bootstrap information to the RAM. In one exemplary implementation, variable latency measures associated with the state machine phase (e.g., ready handshaking) can be disabled before manual control of the NAND flash is implemented.

The random access memory (RAM) implementation phase involves completing the bootstrap operations from the RAM. In one exemplary implementation, when the boot loader is fully operational additional operations can be performed. For example, a display can be turned on, operating system information can be copied to the RAM, a jump can be made to the operating system, additional diagnostics can be performed, and features can be configured.

Figure 4:
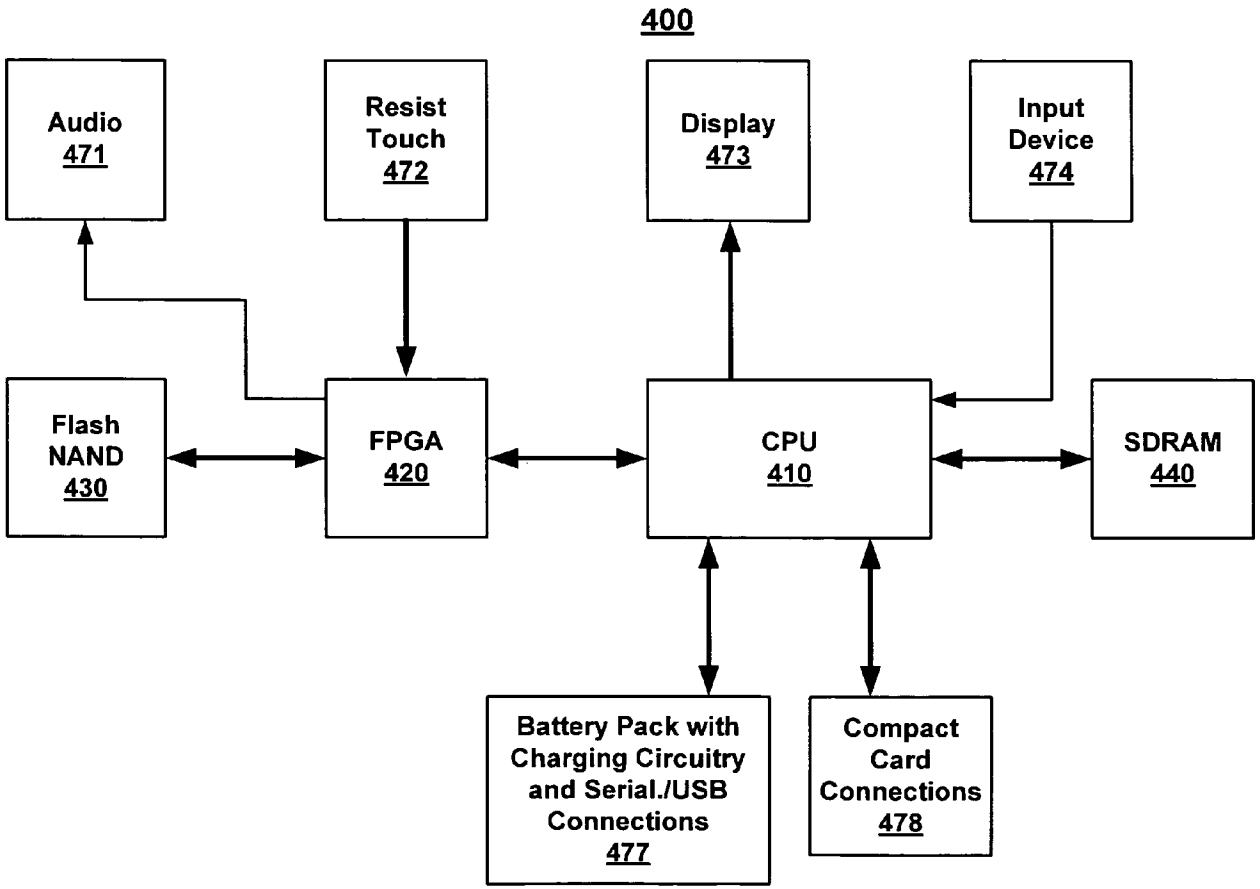
FIG. 4 is a block diagram of an architecture in accordance with one embodiment of the present invention.

FIG. 4 is a block diagram of a architecture 400 in accordance with one embodiment of the present invention. Architecture 400 can be utilized to perform a variety of functions, including audio functions, display functions, GPS functions, etc. Architecture 400 includes central processing unit (CPU) 410, field programmable gate array 420, NAND flash 430, synchronous dynamic random access memory (SDRAM) 440, audio component 471, resistive touch component 472, display 473, input device 474, battery pack with charging circuitry and serial/universal serial bus (USB) connections 474 and compact card connections 478. CPU 410 is communicatively coupled to field programmable gate array 420, synchronous dynamic random access memory (SDRAM) 440, display 473, input device 474, battery pack with charging circuitry and serial/universal serial bus connections 474 and compact card connections 478. Field programmable gate array 420 is communicatively coupled to NAND flash 430, audio component 471, and resistive touch component 472.

The components of architecture 400 cooperatively operate to provide a variety of functions. Central processing unit (CPU) 410 processes information. Synchronous dynamic random access memory (SDRAM) 440 stores information for processing by CPU 410. Field programmable gate array 420 provides ROM emulation controller component functions, controls audio component 471 and resistive touch component 472. NAND flash 430 provides non-volatile memory storage for a variety of functions, including ROM emulation, audio functions, and resist touch functions. NAND flash 430 can also provide storage for operating system instructions. Audio component 471 performs audio functions. Resistive touch component 472 provides resistive touch functions. Display 473 performs display operations. Input device 474 enables information to be input to architecture 400. For example, input device 474 can be a cursor control component. Battery pack with charging circuitry and serial/universal serial bus connections 474 provide mobile power to components included in architecture 400 and communication of information via serial and universal serial bus connections. Compact card connections 478 enables various compact cards to be communicatively coupled to architecture 400.

In one embodiment of the present invention, architecture 400 performs an electronic processing boot up method (e.g., electronic processing boot up method 100). For example, CPU 410 obtains boot strap information from NAND flash 430 via FPGA 420. In one exemplary implementation, field programmable gate array 420 provides ROM emulation controller component functions, and NAND flash 430 provides non-volatile memory storage for a ROM emulation (e.g., boot strap information).

Figure 5:
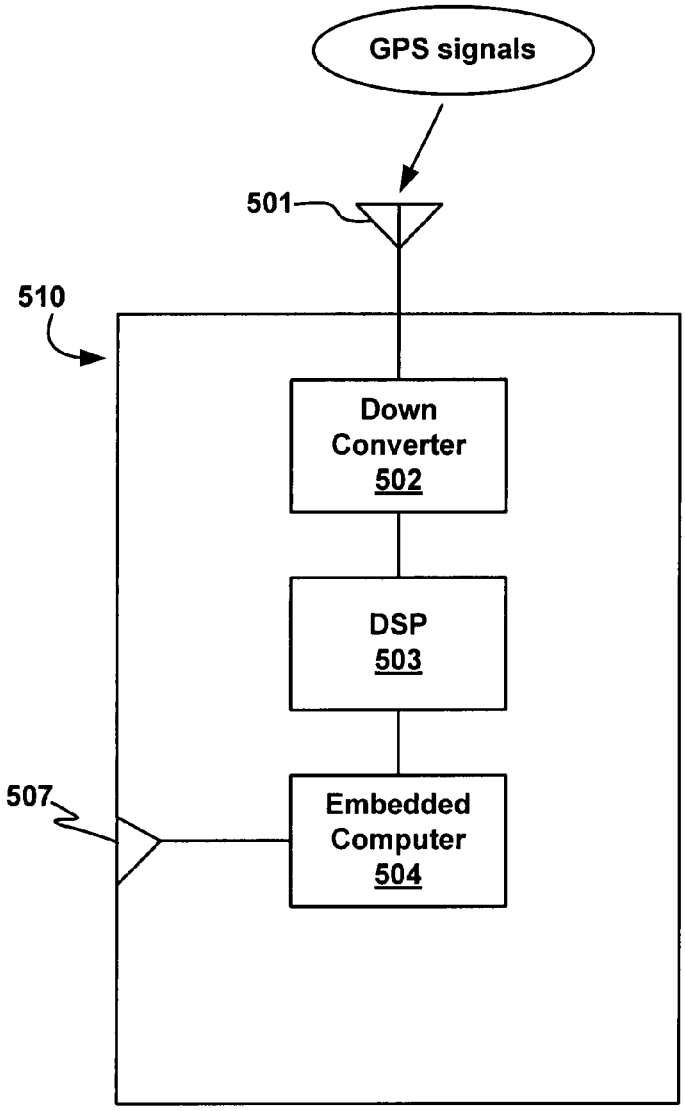
FIG. 5 is a block diagram of a GPS receiver in accordance with one embodiment of present invention.

Referring now to FIG. 5, a block diagram of global positioning system (GPS) receiver 510 in accordance with one embodiment of present invention is shown. GPS receiver 510 is designed to communicate with GPS satellites arranged in a GPS constellation. In one embodiment of the present invention the GPS satellites of the constellation are located in six orbital planes, four satellites in each plane, having an inclination of 55 degrees relative to the equator and an altitude of approximately 20,200 km (10,900 miles). The orbiting GPS satellites each broadcasts spread-spectrum microwave signals encoded with positioning data. The signals can be broadcast on two frequencies (e.g., L1 at 1575.42 MHz and L2 at 1227.60 MHz). Essentially, the signals can be broadcast at precisely known times and at precisely known intervals and encoded with their precise time of transmission. A user receives the signals with a GPS receiver (e.g., GPS receiver 510) designed to determine an exact time of arrival of the signals and to demodulate the satellite orbital data contained therein. Using the orbital data, the GPS receiver 510 determines the time between transmission by the satellite and reception by the receiver and uses this information to determine a pseudo-range measurement of that satellite. By determining the pseudo-ranges of four or more satellites, GPS receiver 510 is able to determine its precise location in three dimensions, velocity, and a time offset which is used to generate a very precise time reference.

Referring to FIG. 5, GPS receiver 510 comprises antenna 501, down converter 502, digital signal processor (DSP) 503, internal embedded computer 504, and communications port 507. Internal embedded computer 504 is coupled to communications port 507 and DSP 503 which is coupled to down converter 502. Down converter 502 is coupled to antenna 510. GPS receiver 510 receives GPS signals via antenna 501. The GPS signals are down converted via down converter 502, then de-spread and demodulated by DSP 503. DSP 503 passes the information to an internal embedded computer 504, which computes the correct pseudo ranges and determines the GPS-based position and velocity. Embedded computer 504 includes a ROM emulation system (e.g., ROM emulation system 300) for storing bootstrap information. Embedded computer 504 is boot up by accessing information in the ROM emulation system (e.g., in accordance with ROM emulation method 100).

In one embodiment of the present invention, the information can be communicated to the user via an optional display (not shown) coupled to the embedded computer. Communications port 507 couples GPS receiver 510 to a bus and provides a communication path for navigation information (e.g. off line, off heading information, etc.). In one embodiment of the present invention GPS receiver 510 includes an input/output component (not shown) as an additional means for communicating information (e.g., configuration information, navigation information, etc.).

It should be appreciated that GPS receiver 510 can be implemented as a differential GPS receiver (DGPS), which provides greater accuracy. To improve the accuracy of GPS determined PVT, differential GPS systems have been developed and widely deployed. As is well known, differential GPS functions by observing the difference between pseudo range measurements determined from the received GPS signals with the actual range as determined from the known reference station point. The DGPS reference station determines systematic range corrections for all the satellites in view based upon the observed differences. The systematic corrections are subsequently broadcast to interested users having appropriate DGPS receivers. The corrections enable the users to increase the accuracy of their GPS determined position. Differential correction broadcasts are currently in wide use throughout the world. Tens of thousands of DGPS receivers have been built and are in operation.

Alternatively, it should be appreciated that GPS receiver 510 can also be implemented as an RTK (real-time kinematics) GPS receiver. RTK is an even more accurate technique for improving the accuracy of GPS. RTK involves the use of two or more GPS receivers which are coupled via a communications link (usually RF based). The GPS receivers are spatially separated and communicate to resolve ambiguities in the carrier phase of the GPS signals transmitted from the GPS satellites. The resulting carrier phase information is used to determine an extremely precise position (e.g., within 2 to 3 centimeters).

Thus, the present invention system and method enables an electronic system to perform bootstrap operations with minimal or no ROM memory. Precious board space and connections on the board are conserved. In addition, relatively inexpensive memory per bit of storage capacity can be utilized to store bootstrap information. For example, NAND flash memory can be utilized to store bootstrap information instead of NOR flash re-programmable ROM memory or electrically programmable read only memory (EPROM). In addition, NAND flash memory utilized in the ROM emulation can be reprogrammed (e.g., new and/or additional information can be written to the NAND flash). Components included in a present ROM emulation system can also be utilized to provide a variety of other functions facilitating even greater conservation of resources.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto and their equivalents.

What is claimed is:

1. An electronic processing boot up system comprising:
- a bus for communicating information;
- a processor coupled to said bus, said processor for processing said information;
- a read only memory (ROM) emulation system coupled to said bus, said read only memory (ROM) emulation system for making boot up information available to said processor, wherein said read only memory comprises a NAND flash memory for storing said boot up information; and
- a state machine for holding off said processor while assembling an instruction stream on the fly for retrieving said boot up information from said NAND flash memory and sending said boot up information to said processor.

2. An electronic processing system of claim 1 wherein said read only memory (ROM) emulation system comprises:
- a controller component for generating commands for retrieving boot up information from said NAND flash and forwarding said boot up information to said processor.

3. An electronic processing system of claim 2 wherein said controller component includes a field programmable gate array.

4. An electronic processing system of claim 1 wherein commands generated by said state machine are compatible with a NAND flash memory protocol for retrieving information.

5. An electronic processing system of claim 1 wherein said read only memory (ROM) emulation system permits reprogramming and recovery after a system crash.

6. An electronic processing system of claim 2 further comprising a joint task action group (JTAG) port for directly controlling electrical signals in said electronic processing boot up system to effect programming of said NAND flash memory with system software.

7. An electronic processing boot up method comprising:
- initiating an initial memory fetch;
- performing a read only memory (ROM) emulation process, wherein said read only memory (ROM) emulation process comprises:
  - receiving a fetch request for information from a processor;
  - translating said fetch request into memory compatible commands for retrieving said information from said processor;
  - holding off said processor while said information from said processor is retrieved; and
  - forwarding said information from said processor in a format compatible with a reply to said memory fetch; and
- passing control to an operating system.

8. An electronic processing boot up method of claim 7 wherein said holding off said processor includes implementation of a ready handshake protocol.

9. An electronic processing boot up method of claim 8 wherein said ready handshake protocol includes:

de-asserting a ready signal in response to said fetch request; and asserting a ready signal when said information from said processor is in a format compatible with a reply to said memory fetch.

10. An electronic processing boot up method of claim 7 wherein said memory compatible commands are compatible with a NAND flash memory.

11. An electronic processing boot up method of claim 7 wherein a ready handshake protocol is initialized.

12. An electronic processing boot up method of claim 7 wherein said translating includes translating a read only memory (ROM) memory access fetch request into NAND flash compatible commands.

13. An electronic processing boot up method of claim 7 further comprising turning on random access memory (RAM) and copying information from a NAND flash memory to said random access memory (RAM), wherein said information includes bootstrap information.

14. An electronic processing boot up method of claim 13 wherein balance of bootstrap information is retrieved from random access memory (RAM).

15. An electronic processing boot up method of claim 13 bad pages of a NAND flash memory are marked and skipped when copying information from said NAND flash.

16. A read only memory emulation system comprising:

a non-volatile memory for storing boot up instructions;

a controller component for interfacing between said non-volatile memory and a processor, wherein a bus couples said non-volatile memory to said processor; and a state machine for holding off said processor while assembling an instruction stream on the fly for retrieving boot up information from said non-volatile memory and sending said boot up information to said processor.

17. A read only memory emulation system of claim 16 wherein said non-volatile memory is a NAND flash memory.

18. A read only memory emulation system of claim 16 wherein said controller component converts fetch cycle operations of said processor into said non-volatile memory access operations.

19. A read only memory emulation system of claim 16 further comprising a volatile memory for receiving boot up instructions from said non-volatile memory and completing a bootstrap sequence.

20. A read only memory emulation system of claim 16 wherein said controller component includes a field programmable gate array component.

* * * * *